US011479039B2

(12) United States Patent
Barbet et al.

(10) Patent No.: US 11,479,039 B2
(45) Date of Patent: Oct. 25, 2022

(54) LOW COST DAMPER

(71) Applicant: Dover Europe Sàrl, Vernier (CH)

(72) Inventors: Bruno Barbet, Etoile-sur-Rhone (FR); Hervé Gregoire, Chateauneuf sur Isere (FR); Adrien Marion, Lyons (FR)

(73) Assignee: Dover Europe Sàrl, Vernier (CH)

( * ) Notice: Subject to any disclaimer, the term of this patent is extended or adjusted under 35 U.S.C. 154(b) by 48 days.

(21) Appl. No.: 17/118,778

(22) Filed: Dec. 11, 2020

(65) Prior Publication Data

US 2021/0187947 A1 Jun. 24, 2021

(30) Foreign Application Priority Data

Dec. 18, 2019 (EP) ..... 19306676

(51) Int. Cl.
*B41J 2/055* (2006.01)
*B41J 2/14* (2006.01)
*B41J 2/175* (2006.01)

(52) U.S. Cl.
CPC ..... *B41J 2/055* (2013.01); *B41J 2/14* (2013.01); *B41J 2/17596* (2013.01); *B41J 2002/14193* (2013.01); *B41J 2002/14483* (2013.01)

(58) Field of Classification Search
CPC ..... B41J 2/055; B41J 2/14; B41J 2/17596; B41J 2002/14193; B41J 2002/14483; B41J 2/17513; B41J 2/17523; B41J 2/17556; B41J 2/175; B41J 2/03
USPC ..... 347/94
See application file for complete search history.

(56) References Cited

U.S. PATENT DOCUMENTS

| | | | | |
|---|---|---|---|---|
| 8,511,809 | B2 | 8/2013 | Yunoki et al. | |
| 2006/0108004 | A1* | 5/2006 | Nakamura | G05D 16/0644 137/510 |
| 2008/0043076 | A1* | 2/2008 | Coffey | B41J 2/17596 347/92 |
| 2018/0086090 | A1* | 3/2018 | Jacobs | B41J 2/17523 |
| 2019/0248413 | A1 | 8/2019 | Barbet | |
| 2020/0207085 | A1 | 7/2020 | Marion et al. | |

FOREIGN PATENT DOCUMENTS

| | | | | |
|---|---|---|---|---|
| EP | 2484527 | B1 | 11/2014 | |
| EP | 3284601 | A1 | 2/2018 | |
| EP | 3332973 | A1 | 6/2018 | |
| EP | 3896283 | A1 * | 10/2021 | B05B 1/32 |
| WO | 2013039886 | A1 | 3/2013 | |

OTHER PUBLICATIONS

Search Report for European application No. EP 19 30 6676 dated May 4, 2020.

* cited by examiner

*Primary Examiner* — Kristal Feggins
*Assistant Examiner* — Alexander D Shenderov
(74) *Attorney, Agent, or Firm* — Pearne & Gordon LLP

(57) ABSTRACT

A damper for a continuous ink jet printer, comprising a fluid receiving chamber (6), comprising at least a lateral wall (22), a fluid inlet (11), and a fluid outlet (12), and at least one membrane (14), the membrane being in a material having a Young modulus between 0.5 MPa and 1000 MPa, the membrane being deformed under the influence of a pressure variation in the first portion.

22 Claims, 6 Drawing Sheets

LOW COST DAMPER

CROSS-REFERENCE TO RELATED APPLICATIONS

This application claims priority from Europe Patent Application No. 19306676.8 filed on Dec. 18, 2019. The content of this application is incorporated herein by reference in its entirety.

PRIOR ART AND TECHNICAL PROBLEMS

Fluid circuits of CIJ (continuous ink jet) printers often comprise a damper, to damp pressure variations of the ink and/or solvent sent to the printing head. Such pressure variations can be of up to several bars, for example between 0.5 bar and 3 bars Known dampers often make use of a membrane combined with a spring, which requires a particular chamber for accommodating the spring, a membrane on top of it and special skills or steps for adjusting the spring in its chamber and the membrane on its top.

Such a damper is difficult to manufacture and there is a need for another damper structure, easier to manufacture.

Such a damper is also bulky, due to the presence of the spring.

SUMMARY OF THE INVENTION

The invention first concerns a damper for a continuous ink jet printer, comprising:

a fluid receiving chamber a fluid inlet to said receiving chamber, and a fluid outlet from said receiving chamber;

at least one membrane, said membrane being in a material having a Young modulus between 0.5 and 1000 MPa.

Said membrane is deformed under a pressure variation in said first portion and thus damps said pressure variations.

Said fluid receiving chamber can be laterally delimited by at least one lateral wall.

It can comprise a further wall, possibly facing said membrane and/or comprising said fluid inlet and outlet. Said walls can be the inner walls of a cover.

In a damper according to the invention, said at least one membrane can have a Young modulus between 50 MPa and 500 MPa, or even 1000 MPa, for example made of PEEK. Both sides of said membrane can be flat.

Means can be comprised between said membrane and said lateral wall, forming a sealing being said fluid receiving chamber and an outside atmosphere of the damper.

A damper according to the invention can further comprise a second chamber, the at least one membrane being disposed between said fluid receiving chamber and said second chamber.

In a damper according to the invention, said at least one membrane can have a Young modulus between 0.5 MPa and 5 MPa or even 10 MPa; a side of said membrane opposite to said fluid receiving chamber can further comprise damping means, for example at least one damping ring or a series of damping studs, preferably disposed along a ring or a circle, protruding from said membrane. Said damper can further comprise a second chamber, or damping chamber, the at least one membrane being disposed between said fluid receiving chamber and said second chamber.

For example, said membrane can be made of a hyperelastic material, such as comprising at least elastomer or EPDM or Teflon.

Said membrane can form a seal between said fluid receiving chamber and an outside atmosphere of the damper.

In a damper according to the invention:

a lateral wall of the damper can have an internal diameter between 10 mm and 40 mm;

and/or said at least one membrane can have a thickness comprised between 0.5 mm and 4 mm.

In a damper according to the invention, said damper, including said fluid receiving chamber, and possibly also the membrane and said second chamber, is/are preferably cylindrical, extending along an axis XX' which is substantially perpendicular to the membrane when it is at rest.

In a damper according to the invention, said fluid receiving chamber can have a volume between 50 $mm^3$ and $10^4$ $mm^3$.

A damper according to the invention can further comprise clamping or fastening means for maintaining at least said fluid receiving chamber, for example delimited by said lateral wall, and said membrane assembled, possibly together with said second chamber.

In a particular embodiment, the outside surface of a lateral wall, respectively of said second chamber, comprises a first threaded part, and the inner portion or wall of said second chamber, respectively of a lateral wall, comprises a second thread cooperating with said first thread.

In a variant, a damper according to the invention can comprise a second membrane, said fluid receiving chamber being disposed between the two membranes: the fluid receiving chamber is limited on two of its sides by said two membranes and by a lateral wall in which said fluid inlet and said fluid outlet open.

The invention further concerns a fluid circuit, for example of, or for, a continuous ink jet printer, comprising a first conduit, a second conduit and at least one damper according to the invention, said first conduit being connected to said fluid inlet and said second conduit being connected to said fluid outlet of said at least one damper.

A fluid circuit according to the invention can further comprise a second damper according to the invention, said second conduit being connected to a fluid inlet of said second damper, said third conduit being connected to a fluid outlet of said second damper.

A fluid circuit according to the invention can further comprise a reservoir and a pump connected to an inlet of said first conduit, said second conduit being connected to a printing head. Said pump can be a gear pump or a diaphragm pump.

The invention further concerns a continuous ink jet printer comprising fluid circuit according to the invention and a print head. The fluid circuit can further include an ink tank. A controller can control the circulation of fluid in the fluid circuit and the print head.

The invention further concerns a method for damping pressure variations of between 2 bar and 5 bar in a fluid circuit of a continuous ink single jet printer, comprising circulating said fluid in at least one damper according to the invention, said pressure variations deforming said at least one membrane which thus damps said pressure variations.

Said pressure variations can for example be comprised between 3 bars and 4 bars.

Said pressure variations can for example be dampened by a factor of 1% to 10% and by a factor below 1%.

BRIEF PRESENTATION OF THE DRAWINGS

Other characteristics and advantages shall appear in the following description of a damper according to the invention, given by way of non-limiting examples, in reference to the annexed drawings wherein.

DETAILED DESCRIPTION OF EMBODIMENTS OF THE INVENTION

Figure 1A:
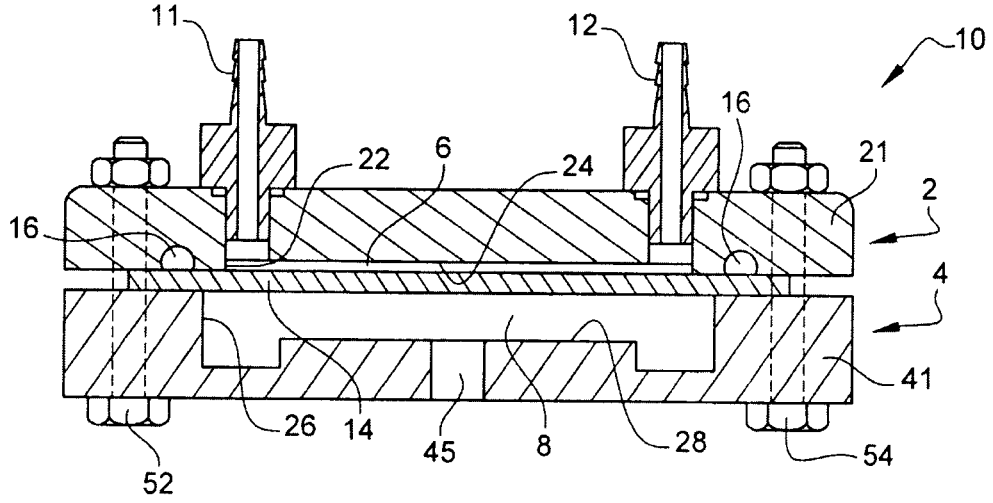
FIGS. 1A and 1B are schematic representations of a first embodiment of a damper according to the invention.
Figure 1B:
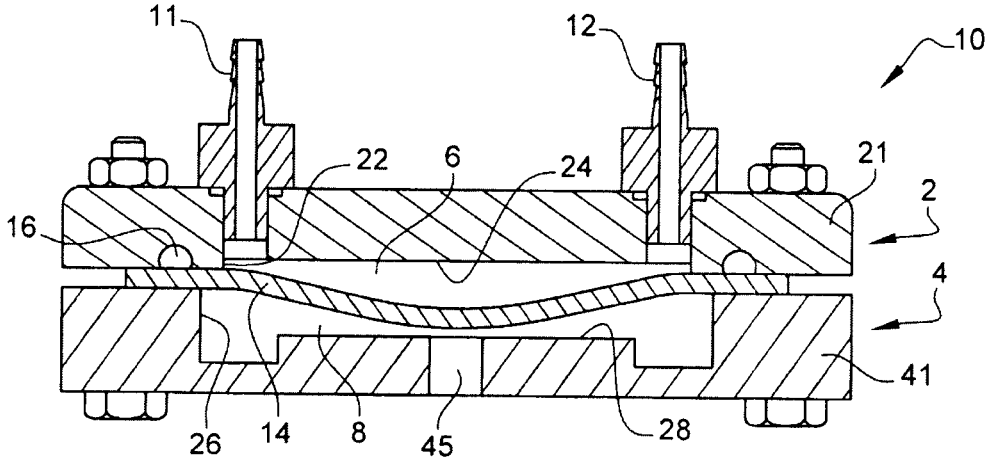

FIGS. 1A and 1B are sections of a first embodiment of a damper 10 according to the invention.

It comprises a fluid receiving portion or chamber 6, delimited by a $1^{st}$ lateral wall 22 and an upper wall 24, and further comprising a fluid inlet 11 and a fluid outlet 12; said fluid receiving portion has an inner diameter defined by the lateral wall 22. A first or upper cap or cover or flange, the internal walls of which form the lateral wall 22 and the upper wall 24, is designated by reference 21; in the rest of this description, this part of the device can also be designated as the "first portion 2".

It can further comprise a second chamber 8, delimited by a $2^{nd}$ lateral wall 26 and a bottom wall 28; said second chamber 8 can be filled with air (or any other gas) or communicates with the atmosphere outside the damper, for example through one or more holes 45 in a second or lower cap or cover or flange 41; in the rest of this description, this part of the device can also be designated as the "second portion 4".

Cap or cover or flange 21, resp. 41, can comprise a flat portion, or wall (the above mentioned "upper", resp. "bottom wall"), and a lateral wall (the above mentioned "$1^{st}$ lateral wall", resp. "$2^{nd}$ lateral wall"), which surrounds the fluid receiving portion or chamber 6, resp. the second chamber 8.

A damping element comprises a flat membrane 14 (or a flexible plate) having a diameter larger than the internal diameter of the fluid receiving chamber; for example it has a diameter between 10 mm or 20 mm and 40 mm or 50 mm; its thickness is for example between 0.5 mm and 2 mm or 3 mm. Such dimensions are adapted to the ink pressure variations in a CIJ printer, the damping efficiency resulting from the surface of the membrane in contact with the fluid in the fluid receiving portion.

The membrane can be applied to the free end of the lateral wall of cap 21, and possibly 41. In an embodiment comprising both caps 21, 41, the membrane is comprised, and can be clamped, between the free ends of both lateral walls of caps 21 and 41.

A damper according to the invention is preferably rotational symmetrical, around an axis XX' which is substantially perpendicular to the membrane when it is at rest. In particular, said fluid receiving chamber and/or its cover 21, and/or the membrane and/or said second chamber and/or its cover 41, is/are preferably rotational symmetrical around said axis XX'.

The membrane 14 is in a material, for example an elastic material, such as PEEK or Delrin or Polyethylene, having a Young modulus between 50 MPa and 100 MPa or 200 MPa or 500 MPa.

In this embodiment, a seal member 16 ensures sealing between the fluid receiving portion 6 and the second chamber 8 and between fluid receiving portion 6 and the outside of the damper. The seal is received in a recess or a groove made on the lower surface of the lateral wall (more precisely: of the cover 21), so that when the two portions are brought and fastened together, with the membrane 14 between them, the seal is compressed between the 1st lateral wall or the cover and the membrane, and the membrane is compressed between, on one side, the $1^{st}$ lateral wall or the cover and the seal, and, on the other side, the second portion. The seal and the membrane form a sealed separation being the first fluid receiving chamber 6 and the second chamber 8 (and the outside of the damper).

FIG. 1B shows that, under the influence of a pressure variation, for example of several bars, in the first fluid receiving portion 6, the membrane 24 of the device presented on FIG. 1A is deformed in the second chamber 8, where it does not come into contact with the bottom wall 28. The deformation of the membrane 24 is linear and elastic, based on a bending moment, the restoring force being given by the bending moment (to the difference with respect to EP 2484527, where the restoring force results from the tensile force).

Hole 45 can be dimensioned such that the pressure in second chamber 8 remains constant during a deformation of membrane 24. In particular, hole 45 is dimensioned such that the pressure in second chamber 8 remains at an atmospheric pressure. Under the influence of pressure variations, membrane 24 bends towards and back in direction of bottom wall 28, without coming into contact with bottom wall 28. Hole 45 is dimensioned such that the air (or any other gas) in second chamber 8 can be evacuated and flow back into chamber 8 such that the air (or gas) pressure in chamber 8 remains constant. A damping effect of the pressure variation is therefore provided by the deformation of membrane 24 alone i.e. a force opposing the pressure variation is provided only due to the deformation of membrane 24.

Alternatively, hole 45 may be closed. As described beforehand, membrane 24 bends towards and back in direction of bottom wall 28 under the influence of the pressure variations. As second chamber 8 is closed in this alternative, a variation of pressure of the air (or gas) contained in chamber 8 occurs.

Membrane 24 and second chamber 8 are configured such that a force on membrane 24, which is caused by said gas or air pressure in chamber 8, remains always very small as compared to a force caused by the deformation of the membrane itself. In other words, the damping effect of the pressure variation is provided by the deformation of the membrane 24 alone. A damping effect caused by the pressure force from the gas or air pressure in chamber 8 remains negligible or technically irrelevant.

Figure 1C:
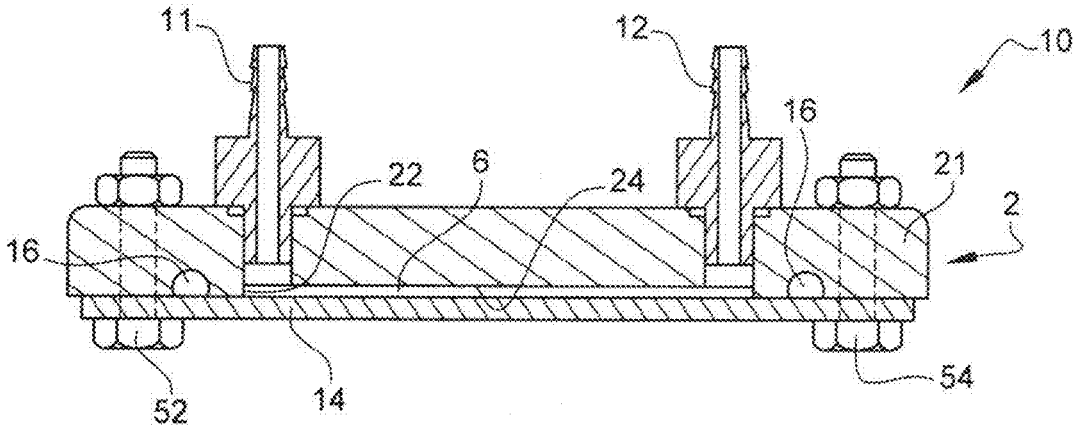
FIG. 1C is a variant of a first embodiment of a damper according to the invention.

A variant of the structure of FIG. 1A, illustrated on FIG. 1C, is similar to FIG. 1A but does not comprise the second portion 4. The membrane 14 is maintained against cover 21, thus forming the receiving portion or chamber 6, by screws (through a peripheral portion or zone of the membrane 14) or by glue (of the peripheral portion or zone of the membrane 14 against cover 21). The advantage of the second chamber of FIGS. 1A and 1B is that it protects the membrane and also the outside atmosphere, should the membrane explode or be torn.

Figure 2D:
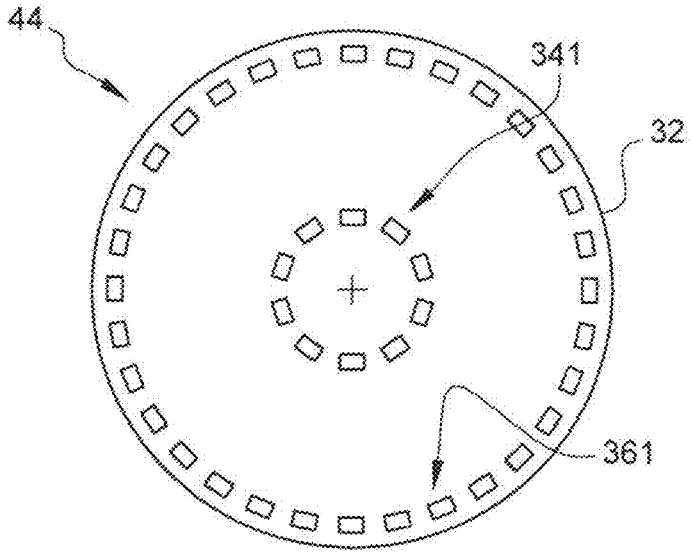
FIG. 2D is a variant of a second embodiment of a damper according to the invention.
Figure 2A:
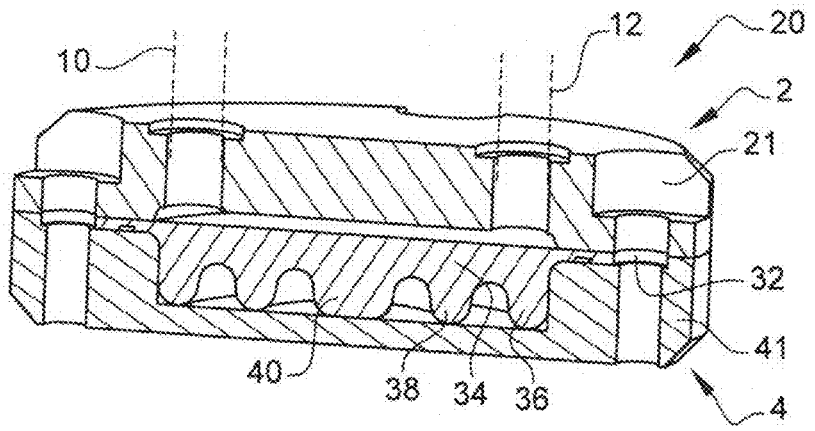
FIGS. 2A-2B are schematic representations of a second embodiment of a damper according to the invention, FIG. 2C showing a simulation of this second embodiment.
Figure 2B:
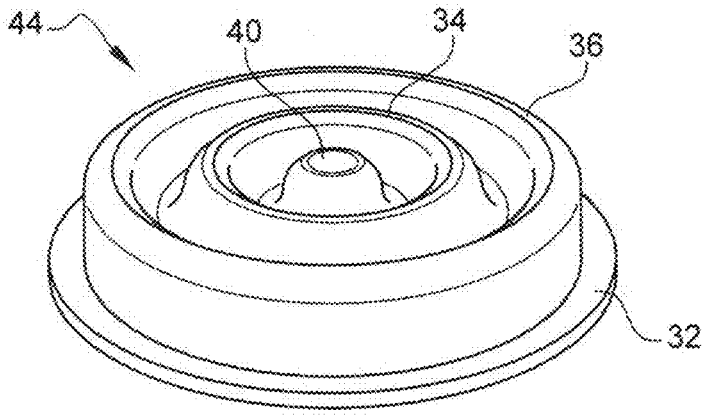

FIG. 2A is a section of a second embodiment of a damper 20 according to the invention, FIG. 2B showing a damping element for this second embodiment.

The damper 20 has the same general structure as the first embodiment.

It comprises a damping element 44, which comprises a flat portion or membrane 32 having a diameter larger than the internal diameter of the fluid receiving chamber; for example it has a diameter between 10 mm or 20 mm and 40 mm or 50 mm; its thickness is for example between 2 mm and 5 mm or 10 mm. Thicknesses lower than 2 mm to shape the back surface are usually not compatible with pressures of up to 3 or 4 bars, which are usual in the field of continuous ink jet printers.

The damping element 44 further comprises damping rings or damping studs 36, 38, 40 which protrude from said flat portion or membrane 32 and which can bear on the lower surface 28 thereby damping the pressure variations without impairing the flexibility of the membrane. They are disposed along circles centered on the center of the membrane 32. On FIGS. 2A and 2B, 2 rings and a central stud are represented, but other embodiments may comprise only 2 rings 34, 36 or 1 ring (for example ring 36) and one central stud 40; alternatively, one or more ring(s) can be replaced by a series of studs aligned according to a circle; this variant is shown on FIG. 2D which is a view from above the surface of the damper comprising the damping studs: it comprises 2 series 361, 341 of studs, each series being disposed along a circle centered on the center of the membrane 32.

The damping member(s) 44 is/are in a material, for example a hyperelastic material, such as an elastomer or EPDM (Ethylene-Propylene-Diene Monomer) or Teflon having a Young modulus between 0.5 MPa and 5 MPa or even up to 10 MPa. It forms a sealed separation being the fluid receiving portion 6 and the second chamber.

In this embodiment, there is no need for an additional seal between fluid receiving portion 6 and the second chamber 8 and between fluid receiving portion 6 and the outside of the damper. The seal is formed by the membrane 32 itself (a hyperelastic material is flexible and ductile so that it can conform to an underlying surface). When the two portions 2, 4 are brought and fastened together, the periphery of the membrane 32 is compressed between them. Thus a sealed separation is formed being the fluid receiving portion 6 and the second chamber 8 and the outside of the device.

Figure 2C:
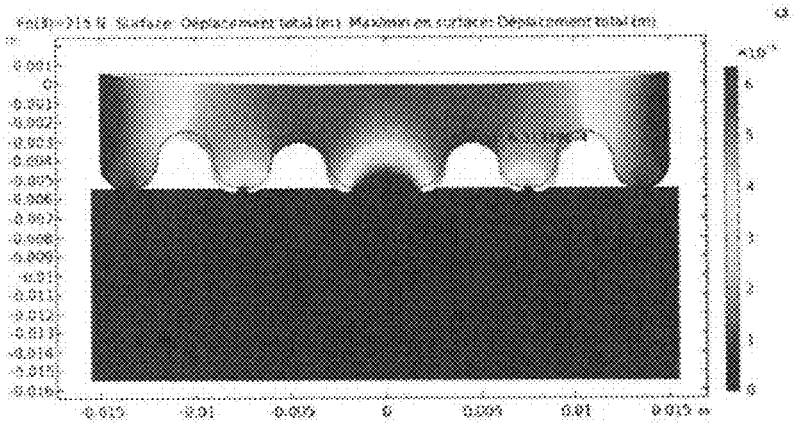

FIG. 2C shows that a pressure variation, for example of several bars, in the first fluid receiving chamber 6, deforms the damping membrane 44 of the device presented on FIGS. 2A and 2B, as well as the damping rings or damping studs 36, 38, 40 which bear on the lower surface 28, thus ensuring a damping effect of the pressure variation. A same or similar effect is obtained for a damping member 44 according to FIG. 2D.

A damper according to the invention can further comprise clamping or fastening means 52, 54 (see FIGS. 1A-1C) for maintaining said first portion and said membrane and possibly said second portion assembled. Said means comprise for example bolts and nuts as illustrated on FIG. 2A, cooperating with corresponding bores in the lateral parts of the first and second covers 21, 41 of the damper; other fastening means (for example screws or clamps) can be implemented instead of the nuts and bolts illustrated on FIG. 1A. The different parts of the device can also be glued, for example with an epoxy glue. All these fastening means can also be implemented in combination with any other embodiment, for example the embodiments of FIGS. 2A-2D and of FIGS. 1, 4 (on which they are not shown just for clarity purposes), or 6A-6B.

Figure 3:
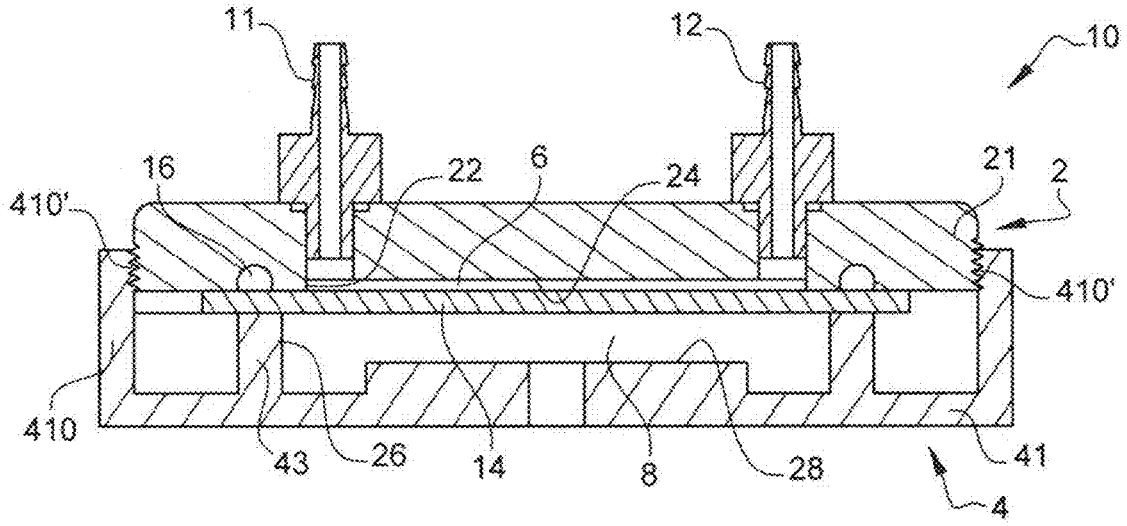
FIGS. 3 and 4 are schematic representations of further variants of an embodiment of a damper according to the invention.
Figure 4:
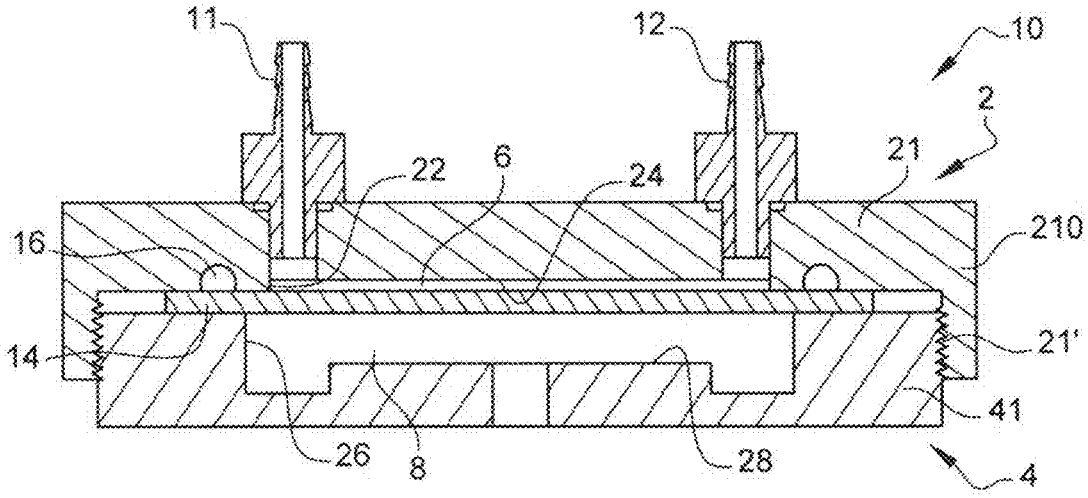

In another embodiment, illustrated on FIGS. 3 and 4, one the two parts 2, 4 is larger than the other one and both parts have threaded portions so that they can be threaded with each other: one of said two parts has a lateral wall which extends in a direction parallel to the axis of the device so as to enclose at least part of the outside lateral wall of the other of said two parts.

On FIG. 3, the second portion 4 has a lateral wall 410 which extends as mentioned above and which has an internal threaded portion 410' cooperating with a threaded portion formed on the outside lateral wall of the first portion 2. The second portion can further comprises a circular crown 43, which delimits the damping chamber and on top of which the bottom surface of the membrane 14, 32 bears when the damper is assembled. This embodiment can also be implemented with a damping element as disclosed in connection with FIGS. 2A-2D (the second portion not comprising an internal circular crown 43).

Alternatively, as illustrated on FIG. 4, the first portion has a lateral wall 210 which has an internal threaded portion 21' cooperating with a threaded portion formed on the outside lateral wall of the second portion 4. This embodiment can also be implemented with a damping element as disclosed in connection with FIGS. 2A-2D. Both portions 2, 4 are threaded together until the membrane is firmly maintained between them.

A damper according to the invention has a damping factor of up to 10% or even 1%: for example a pressure variation of 3 bars can be damped down to 0.3 bar or even 0.03 bar. Further, the damper according to the invention can divide or damp the pressure variation by at least 10 or more or by at least 100 or more. For example, this means that a pressure variation of 3 bars can be damped down to 0.3 bars or less or to 0.03 bars or less.

Further, it is possible to connect a first damper in series with a second damper. The resulting damping factor is the product of the damping factor of the first damper with the damping factor of the second damper.

For example, a series connection of a first damper which divides pressure variations by 10 with a second damper which divides pressure variations by 100 results in a damper combination which divides pressure variations by 1000.

The fluid receiving chamber of a damper according to the invention can have a small height (distance between the upper surface of the membrane 14, 32 and the upper wall 24), for example between 1 mm and 5 mm, resulting in a fluid receiving portion 6 having a low volume, for example between 50 $mm^3$ and $10^4$ $mm^3$. The efficiency of the damper is not affected by such a small volume, the damping efficiency resulting from the surface of the membrane in contact with the fluid receiving portion, not from the volume of the fluid receiving portion. But the fluid receiving portion can be optimized to minimize the fluid pressure drop (the so-called hydraulic resistance). A volume of, for example, between 50 $mm^3$ and $10^4$ $mm^3$ allows this optimization because the flow cross-section between inlet 10 and outlet 12 is still important and therefore the flow of the fluid, and the hydraulic resistance can be small enough.

Figure 5A:
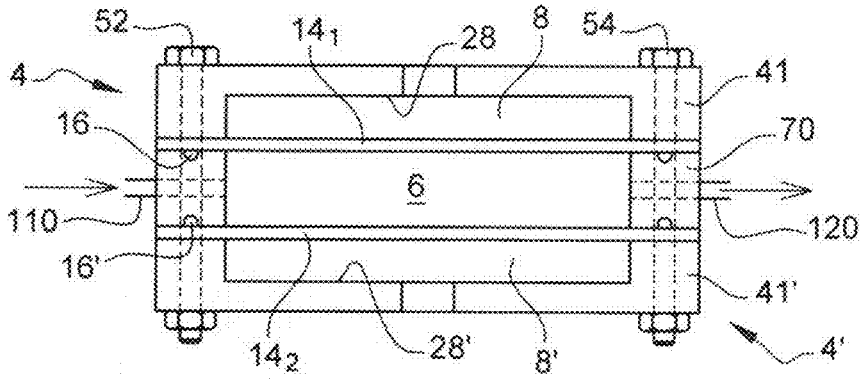
FIGS. 5A-5B are schematic representations of a third embodiment of a damper according to the invention.

Alternatively, a further variant of a damper according to the invention is illustrated on FIG. 5A and comprises two circular flat membranes $\mathbf{14}_1$, $\mathbf{14}_2$ (or flexible plates) disposed parallel to each other, one on each side of a ring 70 (or a portion of a cylinder) and delimiting a fluid receiving portion or chamber 6. The ring is provided with a fluid inlet 110 and a fluid outlet 120. Each membrane $\mathbf{14}_1$, $\mathbf{14}_2$:

has a diameter larger than the internal diameter of the fluid receiving chamber; for example each membrane has a diameter between 10 mm or 20 mm and 40 mm or 50 mm;

and/or a thickness for example between 0.5 mm and 2 mm or 3 mm. The fluid receiving portion 6 has:

a small height (distance between the two membranes at rest), for example between 1 mm and 5 mm;

and/or a low volume, for example between 50 $mm^3$ and $10^4$ $mm^3$. Each of the membranes $\mathbf{14}_1$, $\mathbf{14}_2$ can be in a material, for example an elastic material, such as PEEK or Delrin or Polyethylene, having a Young modulus between 100 MPa and 500 MPa or 1000 MPa. In other words, the presence of 2 membranes allows a broader range of Young modulus.

Each membrane $\mathbf{14}_1$, $\mathbf{14}_2$ separates the receiving portion 6 from a second chamber 8, 8', delimited by a cover 41, 41' similar or identical to cover 41 already described above in connection with FIG. 1A or 1B.

A seal member 16, 16' ensures sealing between fluid receiving portion 6 and each of the second chambers 8, 8' and between fluid receiving portion 6 and the outside of the damper. The seal is received in a recess or a groove made on each upper and lower surface of the ring 70, so that when the ring 70 and the two covers 41, 41' are brought and fastened together, with the membranes $\mathbf{14}_1$, $\mathbf{14}_2$ between them, the seals 16, 16' are compressed between ring 70 and one of the membranes, and each of the membranes is compressed between, on one side, the first cover 41 and the ring 70 (and the seal 16), and, on the other side, the second cover 41' and the ring 70 (and the seal 16'). Each seal 16, resp. 16', and the membrane $\mathbf{14}_1$, resp. $\mathbf{14}_2$, form a sealed separation being the fluid receiving chamber 6 and the second chamber 8, resp.8' (and the outside of the damper).

A variant of the structure of FIG. 5A does not comprise the covers 41, 41'. The fluid receiving chamber is closed by the membranes $\mathbf{14}_1$, $\mathbf{14}_2$ and the device can work without second chambers 8, 8'. The membranes $\mathbf{14}_1$, $\mathbf{14}_2$ are maintained against ring 70, thus forming the receiving portion or chamber 6, by screws (through a peripheral portion or zone of the membranes $\mathbf{14}_1$, $\mathbf{14}_2$) or by glue (of the peripheral portions or zones of the membranes $\mathbf{14}_1$, $\mathbf{14}_2$ against ring 70). The advantage of each second chamber 8, 8' of FIG. 6A is that it protects the membranes and also the outside atmosphere, should one of the membranes explode or be torn.

Figure 5B:
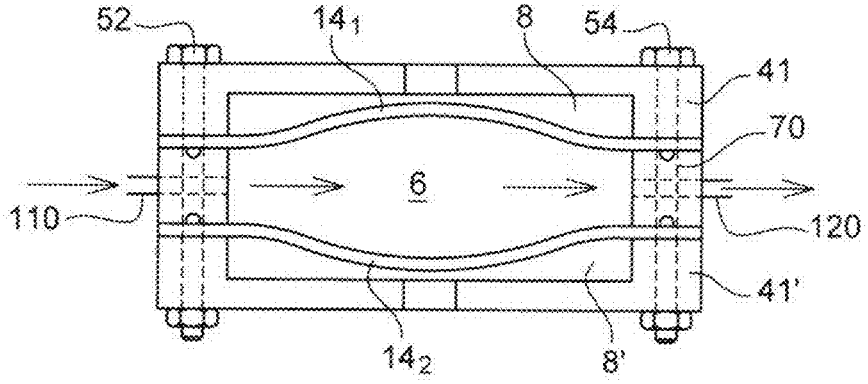

The different parts of the device can be glued together, for example with an epoxy glue; alternatively, clamping or fastening means 52, 54 (see FIGS. 5A and 5B) comprising for example bolts and nuts cooperating with corresponding bores in the lateral parts of all elements 41, 41', $\mathbf{14}_1$, $\mathbf{14}_2$ and 70 of the damper can be implemented; other fastening means (for example screws or clamps) can be implemented instead of the nuts and bolts illustrated on FIGS. 5A and 5B.

FIG. 5B shows that each damping membrane $\mathbf{14}_1$, $\mathbf{14}_2$ of the device presented on FIG. 5A is deformed under a pressure variation, for example of several bars, in the fluid receiving chamber 6; this deformation ensures a damping effect of the pressure variation.

Alternatively, this embodiment can be implemented with damping elements as disclosed in connection with FIGS. 2A-2D, each comprising damping rings or damping studs 36, 38, 40 which can bear on the surfaces 28, 28' and are for damping the pressure variations. Each damping member(s) is/are in a material, for example a hyperelastic material, such as an elastomer or EPDM or Teflon having a Young modulus between 0.5 MPa and 10 MPa or even up to 20 MPa. It forms a sealed separation being the fluid receiving portion 6 and one of the second chambers 8, 8'. In this embodiment, there is thus no need for additional seals between fluid receiving portion 6 and each damping element, a seal being formed by each membrane itself. The diameter and/or thickness of each membrane can be those already mentioned above in connection with FIGS. 6A, 6B.

Figure 6:
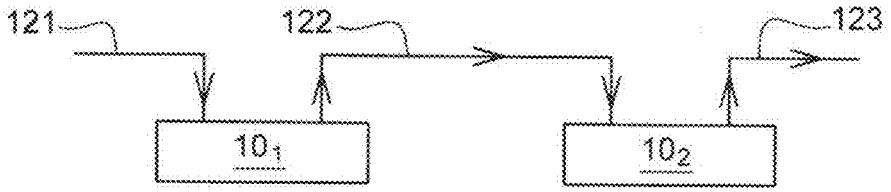
FIG. 6 shows 2 dampers in series, each damper being according to the invention.

The damping effect can be reinforced by implementing two dampers $\mathbf{10}_1$, $\mathbf{10}_2$ in series, each according to the invention, as illustrated on FIG. 6, the fluid circulating through the first damper $\mathbf{10}_1$ and then through the second damper $\mathbf{10}_2$ (both dampers being connected through a duct 122) before flowing to the print head. Each damper $\mathbf{10}_1$, $\mathbf{10}_2$ can be a damper according to any embodiment of the invention. References 121 and 1423 designate the inlet duct into the first damper and the outlet duct out of said second damper.

Any embodiment of a damper according to the invention can be implemented in an ink circuit of a CIJ printer comprising a gear pump to pump the ink; this kind of pump has pressure variations in a range of 2 to 5 bars or 3 to 4 bars; alternatively a diaphragm pump can be implemented, having pressure variations in a range of 100 mbars to 500 mbars. Both pressure variations can be efficiently dampened by a damper according to the invention, the pressure variations being damped down to a factor comprised between 1% and 10% of the above mentioned ranges or even to a factor below 1%.

A damper according to the invention is adapted to a printer comprising a single-nozzle or a multi-nozzle ink jet print head, as represented on FIGS. 1 and 17 of EP 1 718 6002.

A damper according to the invention is connected between an inlet conduit and an outlet conduit of a fluid circuit of a CIJ printer, for example of a circuit connecting a reservoir and the printing head. Said circuit further comprises a pump for pumping fluid from the reservoir. Pressure variations of this fluid are damped by the damper according to the invention.

The materials mentioned in combination with the present invention offer a good resistance to the solvents used in the inks implemented in continuous ink jet printers.

Figure 7A:
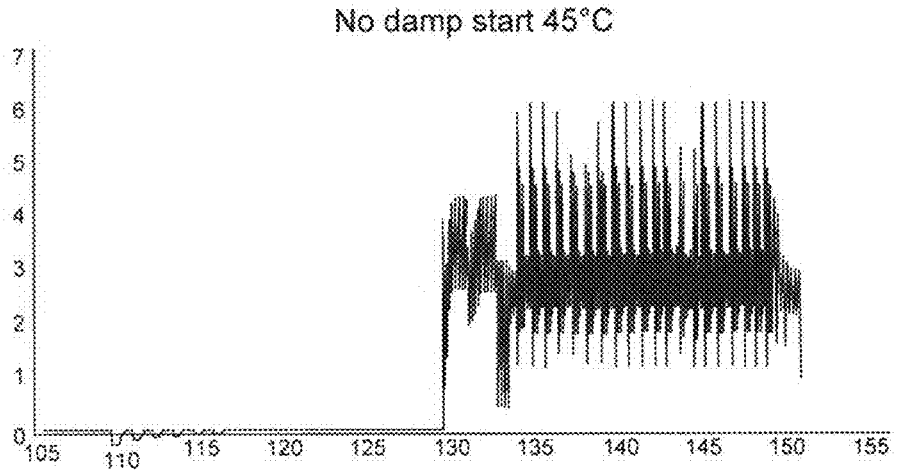
FIGS. 7A-7B show experimental results exhibiting dampening efficiency according to the invention
Figure 7B:
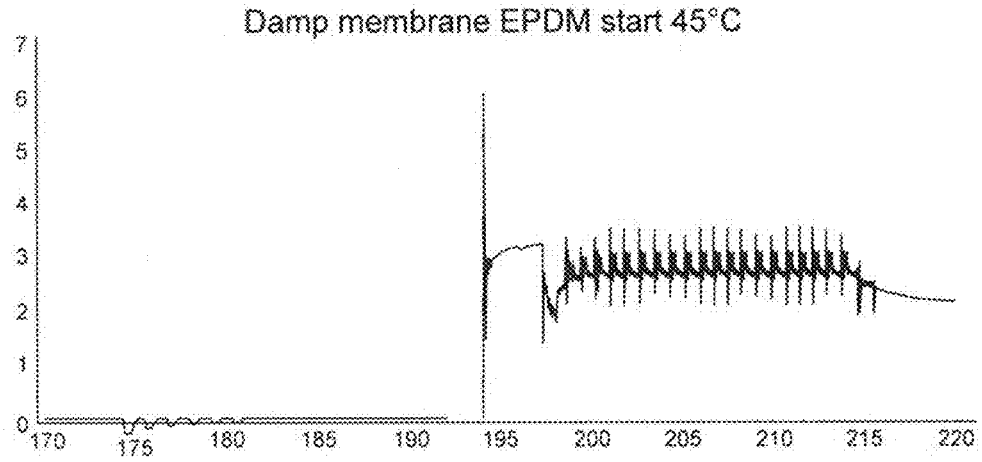

FIGS. 7A and 7B are comparative tests, at 45° C., for a diaphragm pump without (FIG. 7A) and with (FIG. 7B) a damper according to FIG. 2B, with a damping member 44 in EPDM. The pressure is measured at the outlet of the pump (FIG. 7A) and of the damper (FIG. 7B); from these figures it is clear that the damper according to FIG. 2B strongly attenuates the pressure variations resulting from the pump.

The invention claimed is:

1. A damper for a continuous ink jet printer, comprising a fluid receiving chamber, comprising at least a lateral wall, a fluid inlet, and a fluid outlet, a second chamber comprising a bottom wall with a surface, and at least one membrane, said membrane being in a material having a Young modulus between 0.5 MPa and 1000 MPa and comprising damping rings or damping studs which protrude from the membrane, said membrane being deformed under the influence of a pressure variation in said fluid receiving chamber such that the damping rings or damping studs bear on the surface of the bottom wall, thus ensuring a damping of said pressure variation.

2. The damper according to claim 1, said membrane having a Young modulus between 50 MPa and 1000 MPa.

3. The damper according to claim 2, said membrane being made of PEEK.

4. The damper according to claim 2, further comprising a sealing member between said membrane and said lateral wall.

5. The damper according to claim 1, wherein said membrane is comprised between said fluid receiving chamber and said second chamber.

6. The damper according to claim 1, said membrane having a Young modulus between 0.5 MPa and 10 MPa.

7. The damper according to claim 6, said membrane being made of a hyperelastic material, such as comprising at least elastomer or EPDM or Teflon.

8. The damper according to claim 6, said membrane forming a seal between said fluid receiving chamber and an outside atmosphere of the damper.

9. The damper according to claim 1, said lateral wall, having an internal diameter between 10 mm and 40 mm.

10. The damper according to claim 1, said membrane having a thickness comprised between 0.5 mm and 4 mm.

11. The damper according to claim 1, said damper being cylindrical, extending along an axis XX'.

12. The damper according to claim 1, further comprising clamping or fastening means for maintaining said membrane and said lateral wall, and possibly said second chamber.

13. The damper according to claim 12, the outside surface of one of said lateral wall, respectively said second chamber, comprising a first threaded part and the inner portion of said second chamber, respectively said lateral wall, comprising a second thread cooperating with said first thread.

14. The damper according to claim 1, said fluid receiving chamber having a volume between 50 $mm^3$ and $10^4$ $mm^3$.

15. The damper according to claim 1, comprising a second membrane, said lateral wall and said fluid receiving chamber being disposed between the two membranes.

16. The damper according to claim 1, comprising an upper wall, said fluid receiving chamber being disposed between said upper wall and said membrane.

17. A fluid circuit of a continuous ink jet printer, comprising a first conduit, a second conduit and at least one damper according to claim 1, said first conduit being connected to said fluid inlet and said second conduit being connected to said fluid outlet of said at least one damper.

18. The fluid circuit according to claim 17, comprising a second damper, said second damper comprising:

a fluid receiving chamber, comprising at least a lateral wall, a fluid inlet, and a fluid outlet, a second chamber comprising a bottom wall with a surface, and at least one membrane, said membrane being in a material having a Young modulus between 0.5 MPa and 1000 MPa and comprising damping rings or damping studs which protrude from the membrane said membrane being deformed under the influence of a pressure variation in said fluid receiving chamber such that the damping rings or damping studs bear on the surface of the bottom wall, thus ensuring a damping of said pressure variation, said second conduit being connected to the fluid inlet of said second damper, a third conduit being connected to the fluid outlet of said second damper.

19. The fluid circuit according to claim 17, further comprising a reservoir and a pump connected to an inlet of said first conduit, said second conduit being connected to a printing head.

20. The fluid circuit according to claim 19, said pump being a gear pump or a diaphragm pump.

21. A method for damping pressure variations of between 2 bar and 5 bar in a fluid circuit of a continuous ink single jet printer, comprising circulating said fluid in at least one damper according to any of claim 1, said pressure variations deforming said at least one membrane which thus dampens said pressure variations.

22. The method according to claim 21, said pressure variations being between 3 bars and 4 bars.

* * * * *